US005622474A

United States Patent [19]

Werner et al.

[11] Patent Number: 5,622,474

[45] Date of Patent: Apr. 22, 1997

[54] BLADE TIP SEAL INSERT

[75] Inventors: Klemens Werner, Munich; Paul Lottes, Groebenzell; Hans-Juergen Schmuhl, Woerthsee; Lothar Reisinger; Gerhard Wydra, both of Dachau; Dietrich Schulte, Puchheim, all of Germany

[73] Assignee: MTU Motoren- Und Turbinen-Union Muenchen GmbH, Munich, Germany

[21] Appl. No.: 528,053

[22] Filed: Sep. 14, 1995

[30] Foreign Application Priority Data

Sep. 14, 1994 [DE] Germany ..... 44 32 685.8

[51] Int. Cl.[6] ..... F01D 11/12

[52] U.S. Cl. ..... 415/173.1; 415/200

[58] Field of Search ..... 415/173.1, 197, 415/200; 156/72; 428/97

[56] References Cited

U.S. PATENT DOCUMENTS

| | | | |
|---|---|---|---|
| 3,808,087 | 4/1974 | Milewski et al. | 428/95 |
| 4,273,824 | 6/1981 | McComas et al. | 415/200 |
| 4,289,447 | 9/1981 | Sterman et al. | 415/200 |
| 5,520,508 | 5/1996 | Khalid | 415/173.1 |

FOREIGN PATENT DOCUMENTS

| | | | |
|---|---|---|---|
| 3606283 | 2/1987 | Germany . | |
| 4310104 | 9/1994 | Germany | 415/173.1 |
| 1260554 | 9/1986 | U.S.S.R. | 415/173.1 |

*Primary Examiner*—Edward K. Look
*Assistant Examiner*—Michael S. Lee
*Attorney, Agent, or Firm*—Evenson, McKeown, Edwards & Lenahan, P.L.L.C.

[57] ABSTRACT

Run-on linings for turbo-engines are arranged between the free ends of moving blades and a housing of a compressor or a turbine of a turbo-engine. The run-on linings are formed of a carrier and fiber bundles and are fastened on the circumference of the housing.

4 Claims, 1 Drawing Sheet

BLADE TIP SEAL INSERT

BACKGROUND AND SUMMARY OF THE INVENTION

This invention relates to a run-on lining (also known as a blade tip seal insert) for the housing of a turbo-engine and, more particularly, to a lining constructed as a ring-type carpet on the circumference of the housing opposite the moving blades of a turbo-rotor, and including a carrier in which ceramic fibers are held, the free fiber ends projecting radially toward the inside out of the carrier. The invention further relates to a process for manufacturing such a run-on lining.

Run-on linings are arranged between the free ends of moving blades and a housing of a compressor or of a turbine of a turbo-engine. During the operation of such engines, the run-on linings are subjected to high specific stresses.

There is therefore needed a run-on lining for turbo-engines which is reasonable in cost, simple to manufacture, efficient and resistant to wear. There is also needed a process for mounting such run-on linings for turbo-engines.

These needs are met according to the present invention by a run-on lining for turbo-engines constructed as a ring-type carpet on the circumference of the housing opposite the moving blades of a turbo-rotor, and including a carrier in which ceramic fibers are held, the free fiber ends projecting out of the carrier radially toward the inside. The carrier is a SiC fabric mat having fabric strands which essentially cross one another at right angles. The ceramic fibers in the respective nodal points wind around both mutually crossing fabric strands while forming an apex.

A process for manufacturing such a run-on lining for turbo-engines includes the steps of: a) placing fiber bundles in a carrier such that the fiber bundles are directed via their free ends radially toward the inside; b) fastening the fiber bundles in the carrier; and c) fastening the carrier in the housing.

The run-on lining according to the present invention for turbo-engines may be prefabricated outside the housing from simple and cost-effective elements, such as a carrier and fiber bundles made of SiC-loops, and may subsequently be fastened in the housing. The alignment of the fiber ends of the fiber bundles on moving blades results in an effective sealing-off of the moving blades without any significant rotational impairment of the moving blades. The run-on lining for turbo-engines according to the invention is very wear resistant.

German Patent document DE 43 10 104 A1 describes a lining on the interior side of a turbo-engine housing. The lining is constructed as a ring-type carpet on the circumference opposite moving blades of a rotor. From the previously known German Patent document DE 36 06 283 A1, a brush seal is known for sealing off circumferential gaps. The brush seal is made of silicium carbide fibers. Ceramic fibers are used as the bristle material for the brush seal. However, these known references do not contain any information concerning a run-on lining made completely of ceramic material, or its design so that it can be produced at low cost.

For improving the accommodation and the durability of the run-on lining for turbo-engines, the housing of the turbo-engine, according to an advantageous embodiment of the invention, is provided with one or several grooves extending in the circumferential direction.

The mounting of the run-on lining according to the invention in one piece or in sections allows for specific conditions of the turbo-engine to be taken into account.

According to the present invention, a process for manufacturing run-on linings for turbo-engines is also provided by which the run-on lining for turbo-engines can be worked particularly advantageously into housings of turbo-engines.

Other objects, advantages and novel features of the present invention will become apparent from the following detailed description of the invention when considered in conjunction with the accompanying drawings.

DETAILED DESCRIPTION OF THE DRAWINGS

Figure 1:
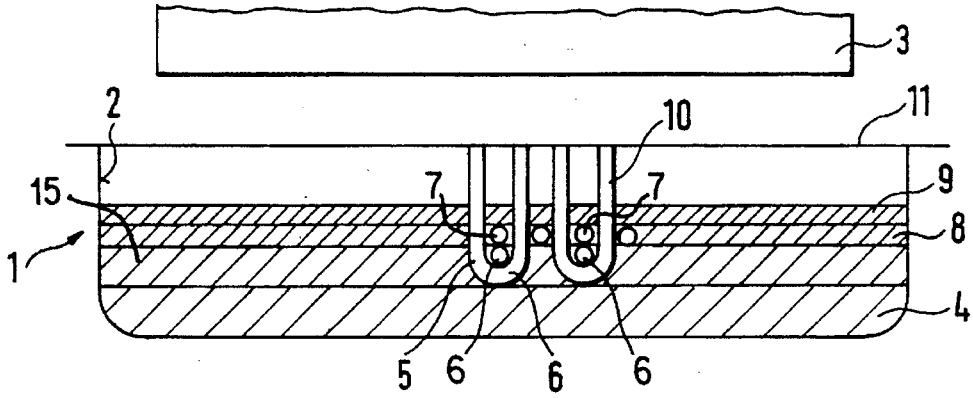
FIG. 1 is a cross-sectional view of a run-on lining for turbo-engines arranged in a housing.

In FIG. 1, a run-on lining for turbo-engines is provided in a housing 1 of a turbo-engine (not shown). The housing 1 has a turned groove 2 extending in the circumferential direction. A moving blade 3 rotates about a longitudinal axis (not shown) of the turbo-engine.

The groove 2 has a layer 4 which contains a heat insulation material formed of sprayed ZrO2. The layer 4 may have a thickness of approximately 0.7 cm. Fiber bundles 5 are made of SiC-fiber loops with or without a fiber core or, depending upon the temperature requirements, made of plastic fibers. The fiber bundles include apexes 6 which rest against the layer 4. The apexes 6 of the fiber bundles 5 are held in the groove 2 by a carrier 7. Carrier 7 is a sieve made of a metallic material, such as X-10 or Inconel R or a SiC-fabric mat. However, honeycombs (not shown) may also be provided as the carrier.

The carrier 7 is embedded in a layer 8 with a bonding agent, such as a ceramic bonding agent, which is compatible with the sprayed ZrO2-layer, or in a sintered powder metal or in plastic. Layer 8 is adjoined by layer 9 of the carrier 7. The thickness of the layers 4, the apexes 6 of the fiber bundles 5, the layers 8 and 9 result in a total thickness of approximately 1.5 cm.

The free ends 10 of the fiber bundles 5 are directed toward the longitudinal axis of the turbo-engine and project by 0.7 cm beyond the layer 9 up to the surface profile 11 of the groove 2. The free ends 10 of the fiber bundles 5 are free of any bonding agent, sintered powder metal or plastic, and function to seal off the moving blades 3 with respect to the housing 1.

Figure 2:
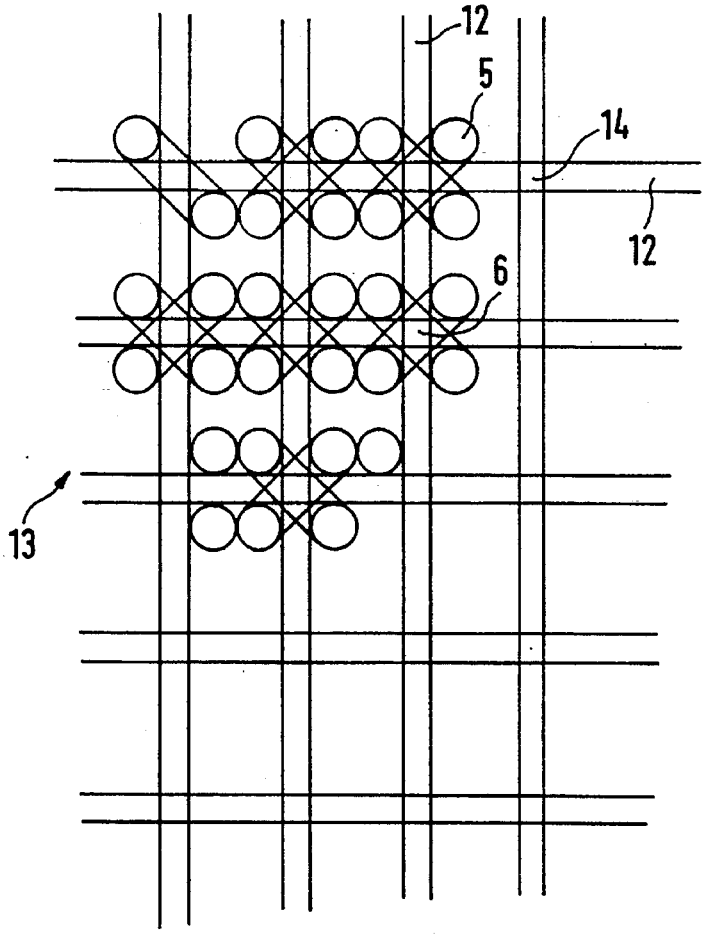
FIG. 2 is an illustrative view of a carrier with fiber bundles.

The process for mounting run-on linings for turbo-engines will now be described with respect to FIG. 2. In FIG. 2, the reference numbers from FIG. 1 are used for identical characteristics. The carrier 7 is formed by a plane mat 13 arranged in a strip shape. The fiber bundles 5 made of SiC-loops are inserted into the mat 13. Strands 12 of the mat 13 cross one another at right angles at nodal points 14. Two free ends 10 of the fiber bundles 5, respectively, are connected with an apex 6. The apex 6 is supported on one of the nodal points 14 formed by the two strands 12 of the mat 13. The fiber bundles 5 are arranged so as to cross one another at the nodal points 14. On the side of the mat 13 on which the apexes 6 of the fiber bundles 5 are arranged, the carrier 7 is coated with a ceramic bonding agent and is glued at 15 in the groove 2 of the housing 1 onto the already applied ZrO2-layer 4. This is done so that the mat 13 is adapted to the cylindrical shape of the housing. The carrier 7 and the fiber bundle 5 thus form a ring-type carpet having a minimal height. As an alternative, the plane mat 13 may have an annular shape and may then be sintered to form two half-rings or curved segments (not shown). Individual segments can then be soldered or glued onto the already sprayed ZrO2-layer 4 in the groove 2 of the housing 1.

Ceramic binders may contain, for example, Al-, Mg-, K-, Na-silicate or, at 1,400° C., may contain Cr-phosphate, at 1,200° C., may contain Al-phosphate, at 350° C., may contain Mg-phosphate which. For the purpose of hardening, the ceramic binders may be combined with $SiO_2$. However, organic binders, such as alkyl silicate, are also suitable. A pigmentation may take place optionally by means of $Cr_2O_3$, $Al_2O_3$, $ZrO_2$, Mg-oxide, $Fe_2O_3$ or silicates, bentones or Kadin.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A run-on lining for a housing of a turbo-engine having a turbo-rotor with moving blades, comprising:

a ring-type carpet arranged on an inner circumference of the housing opposite the moving blades;

wherein said ring-type carpet comprises a carrier holding ceramic fibers having free fiber ends which project out of said carrier radially inward, said carrier being an SiC fabric mat having fabric strands crossing one another at right angles forming nodal points; and wherein said ceramic fibers are wound around said fabric strands at said nodal points so as to form an apex of said ceramic fibers.

2. A run-on lining according to claim 1, wherein said housing includes at least one groove extending in a circumferential direction, said ring-type carpet being fixed on said at least one groove.

3. A run-on lining according to claim 1, wherein said ring-type carpet is composed of segments which are uniformly distributed over a circumference of the housing.

4. A run-on lining according to claim 1, wherein said carrier is a plane mat prior to installation on the housing.

* * * * *